US010973319B2

(12) United States Patent
Eames

(10) Patent No.: US 10,973,319 B2
(45) Date of Patent: Apr. 13, 2021

(54) WARDROBE APPARATUS

(71) Applicant: Loftrobe LTD., Hants (GB)

(72) Inventor: James Alen Eames, Hants (GB)

( * ) Notice: Subject to any disclaimer, the term of this patent is extended or adjusted under 35 U.S.C. 154(b) by 0 days.

(21) Appl. No.: 16/500,999

(22) PCT Filed: Apr. 6, 2018

(86) PCT No.: PCT/IB2018/052400
§ 371 (c)(1),
(2) Date: Oct. 4, 2019

(87) PCT Pub. No.: WO2018/185721
PCT Pub. Date: Oct. 11, 2018

(65) Prior Publication Data

US 2020/0029687 A1 Jan. 30, 2020

(30) Foreign Application Priority Data

Apr. 6, 2017 (GB) ..... 1705581

(51) Int. Cl.
*A47B 61/00* (2006.01)
*A47B 51/00* (2006.01)

(52) U.S. Cl.
CPC ..... *A47B 61/006* (2013.01); *A47B 51/00* (2013.01); *A47B 2051/005* (2013.01)

(58) Field of Classification Search
CPC . A47B 61/006; A47B 51/00; A47B 2051/005; A47B 61/00; A47B 61/02; A47G 25/0692
See application file for complete search history.

(56) References Cited

U.S. PATENT DOCUMENTS 1,370,275 A * 3/1921 Brager ..... A47B 61/02 211/85.3
1,393,327 A * 10/1921 Taylor ..... A47F 7/06 312/133
1,587,675 A * 6/1926 Patterson ..... A47B 61/02 211/1.3
2,235,574 A * 3/1941 Derman ..... A47B 61/06 312/260
2,499,791 A * 3/1950 Spencer ..... A47B 51/00 312/247
2,702,734 A * 2/1955 Kroll ..... A47B 61/02 312/275
2,740,531 A * 4/1956 Simpkins ..... A47B 61/02 211/85.3
4,740,044 A * 4/1988 Taylor ..... A47B 21/03 312/196
5,475,949 A * 12/1995 McCoy ..... A47B 51/00 312/242
5,647,492 A 7/1997 Fillios et al.
(Continued)

FOREIGN PATENT DOCUMENTS

CN 201617521 U 11/2010
CN 205030767 U 2/2016
(Continued)

*Primary Examiner* — Hanh V Tran
(74) *Attorney, Agent, or Firm* — David Guerra

(57) ABSTRACT

A wardrobe apparatus comprising a body supporting a rail, a frame, and a movement mechanism, wherein the actuation means is arranged to move the rail vertically from a first position distal the frame to a second position proximate the frame.

20 Claims, 14 Drawing Sheets

(56) References Cited

U.S. PATENT DOCUMENTS

| | | | | |
|---|---|---|---|---|
| 6,202,359 | B1 * | 3/2001 | Reed | A47B 51/00 312/268 |
| 8,870,145 | B1 | 10/2014 | Carlson et al. | |
| 10,436,398 | B2 * | 10/2019 | Solterbeck | F21V 33/0088 |
| 10,512,342 | B2 * | 12/2019 | Santicchi | A47F 5/025 |
| 2006/0066188 | A1 * | 3/2006 | Crawford | E04B 9/003 312/247 |
| 2008/0289264 | A1 * | 11/2008 | Bowman | A47B 51/00 52/29 |
| 2009/0016046 | A1 * | 1/2009 | Witsenburg | A47G 25/0692 362/145 |
| 2010/0122963 | A1 * | 5/2010 | Costa | A47G 25/746 211/94.01 |
| 2014/0252930 | A1 * | 9/2014 | Reid | A47B 51/00 312/247 |
| 2015/0216298 | A1 * | 8/2015 | DeLorean | F24F 13/20 312/236 |
| 2016/0278517 | A1 * | 9/2016 | DeLorean | E04B 9/02 |
| 2017/0055720 | A1 * | 3/2017 | Lin | A47C 20/041 |

FOREIGN PATENT DOCUMENTS

| | | | |
|---|---|---|---|
| DE | 3803573 | C2 | 6/1989 |
| EP | 2649903 | A1 | 10/2013 |
| FR | 2636222 | A1 | 3/1990 |
| GB | 2460702 | A | 12/2009 |

* cited by examiner

WARDROBE APPARATUS

CROSS-REFERENCE TO RELATED APPLICATIONS

This application is an U.S. national phase application under 35 U.S.C. § 371 based upon co-pending International Application No. PCT/IB2018/052400 filed on Apr. 6, 2018. Additionally, this U.S. national phase application claims the benefit of priority of co-pending International Application No. PCT/IB2018/052400 filed on Apr. 6, 2018 and Great Britain Application No. 1705581.5 filed on Apr. 6, 2017. The entire disclosures of the prior applications are incorporated herein by reference. The international application was published on Oct. 11, 2018 under Publication No. WO 2018/185721 A1.

FIELD OF THE INVENTION

The present invention relates to wardrobe apparatus, in particular a space saving wardrobe apparatus; more particularly but not exclusively apparatus for situating a wardrobe in a ceiling void.

BACKGROUND

Increasing pressures on space combine with greater purchasing power and an increase in personal possessions, an aesthetic awareness and a general desire to look one's best.

As a consequence many people accumulate a large amount of clothing, toiletries and other items. Often there is little space to store these increasing numbers of personal possessions and clothes particularly in urban environments.

In many homes however, whilst living space is limited, loft space has been underused.

PRIOR ART

CN 204 812 738 (Chen) discloses a vertical lift cabinet, including box, locker, circular orbit and rotation piece, wherein the circular orbit fixes the setting symmetrically and is in both sides of a box, and rotates the piece symmetrically CN 203 735 749 (Que) discloses a remote controlled suspended ceiling capable of lifting which has a storage function. The suspended ceiling comprises a box body. An opening is formed in a side wall of the box body. The opening is provided with two or more movable cover plates. A plurality of slings are capable of being hung at the top of a room and are arranged on the box body and a control mechanism controls the raising and lowering of the suspended ceiling.

FR 2 605 506 (Garcia et al) discloses a clothes closet which can be retracted into the ceiling into which is built into a suspended storage device that comprises a plurality of individual juxtaposed tilting panels. At least one guide support is fixed at a distance from an internal face of a panel. A slide is capable of moving along the guide support and is attached to a bracket bent at right angles and receives a series of hangers.

US Patent Application 2008/289264 (Bowman) discloses a closet that retracts into an attic or loft space.

U.S. Pat. No. 5,475,949 (McCoy) discloses a ceiling mounted wardrobe apparatus that is lowered into a room by way of a rack-and-pinion drive mechanism.

EP 2 649 903 (J&S Innovative Products) discloses a ceiling mounted organiser which supports a container or clothes hanger which is raised and lowered by way of a motor.

U.S. Pat. No. 8,870,145 (Carlson) discloses a clothes hanger which is hoisted and lowered from a ceiling support.

DE 3 803 573 (Bloksma) discloses a clothes hanger operated by way of a battery powered motor.

FR 2 636 222 (Heyberger) discloses a rotary support that is suspended from and connected to a ceiling.

The present invention arose in order to overcome problems suffered by existing devices.

SUMMARY OF THE INVENTION

According to the present invention there is provided a wardrobe apparatus which in a retracted position is received in an insulated casket that is located in a space in a loft, and in deployed position is lowered into a room below the loft, the wardrobe apparatus comprises: a wardrobe body which supports a clothes rail; a frame is fixed to a joist or beam in the loft and defines an opening into the loft; and at least one motor is arranged to lower and raise the wardrobe vertically, the clothes rail has a plurality of hangers that are rotated by an actuator with respect to the rail during movement between the raised and lowered positions, so as to enable hangers to pass through the opening.

Optionally one or more drawers are provided in the wardrobe, in an upper or preferably a lower, region of the wardrobe. The, or each, drawer is ideally slidable laterally so as to allow stowage of smaller items of clothing, footwear or toiletries.

The frame is installed in a ceiling or roof void such that when the wardrobe moves below the ceiling the rotating hanger mechanism is operated. The frame also comprises a ceiling securement means which is a rigid steel frame. The ceiling securement means spreads the weight of the frame and the apparatus in general across joists or rafters in the attic or loft.

Motors are preferably connected to rigid steel frame that is supported in a ceiling void or an attic. The frame is connected to joists or rafters so as to provide a secure and stable support for the motors. Motors are powered either by way of a mains supply or more or more batteries that are preferably rechargeable. Where the batteries are rechargeable they may be fitted to the wardrobe and so are movable with the wardrobe. In such instances connectors are arranged to contact a suitable connection in the ceiling so that the batteries are able to recharge when the wardrobe is returned to the loft space.

Motors are ideally fitted with a tension sensing means that halts motors as soon as cables or cords slacken. Preferably the motors are also configured to retract at, or shortly after, slackening is sensed so that the wardrobe is suspended a small distance above a floor or other surface. This ensures that all cables remain taut and the wardrobe is maintained in a plumb or 'true' state.

The frame defines an aperture into which the wardrobe is moved by the movement mechanism. The housing protects the body, rail and any associated clothing or items from dust and damage when above the ceiling.

In this way the housing and/or rail provide a hanging solution that takes up no floor space in a room, and instead utilises an otherwise redundant void space in a loft or attic.

The wardrobe body and frame preferably comprise an elongate, rectangular footprint, so as to surround and support the clothes rail and maintain a minimal footprint. In this way the wardrobe body comprises two relatively long side sections and two relatively short ends. This shape is received between conventionally spaced rafters and the length is selected so as not to interfere with any pipework, ducting or cabling that may be present in a loft space.

The wardrobe body may be substantially open, so as to allow access to the rail from either a front or rear sides, when in the deployed position.

The casket or housing is ideally closed on five faces, namely two sides, two ends and a top. The bottom of the casket or housing defines an opening for receiving the wardrobe body.

There is preferably a locking means for locking the ward bode body when retracted in the loft so as to prevent or limit unintentional vertical movement of the body. The locking means may be arranged to engage with rafters and/or the frame. An optional weight spreading bar may be arranged to spread the weight of the apparatus as well as engage with the locking means. An automatic sensor is ideally provided to deploy locking means, which are preferably bolts at two, three or preferably four locations so as to engage the wardrobe body at different positions. The benefit of this is that the weight of the wardrobe is spread over different locations and as each locking means operates independently of another, a failsafe mechanism is provided in the event of one locking means failing to deploy.

The wardrobe body may comprise further item storage options, for example comprising at least one drawer or at least one door.

The frame is ideally formed form steel or aluminium sections arranged to spread the load of the apparatus across the ceiling. For example the frame may comprise horizontal support sections, arranged to lie across rafters in the ceiling void.

In some embodiments the clothes rail comprises a plurality of hangers, permanently or in use. Such hangers may extend laterally from the rail, and are spaced longitudinally along the rail. Hangers may be secured permanently or semi-permanently to the rail, so as to limit accidental displacement from the rail, for example during the body movement between positions.

Rotation of the hangers is ensured so that all rotate together, such that the hangers rotate simultaneously. For example in some embodiments the rotation may be linked to the position of the apparatus; wherein when the rail is lowered the hangers are substantially orthogonal to the rail and as the rail is raised the hangers are rotated to minimise the widthwise space they occupy.

In this way the hangers may be rotated from their deployed position, which is substantially orthogonal with respect to the clothes rail from which they are hanging, to one in which the hangers are less than 90° with respect to the axis of the clothes rail in the stowed or raised position thereby enabling the wardrobe body to pass through the opening onto the loft because the 'footprint' of the apparatus is reduced.

In some embodiments the mechanism may be manually operated and this may be useful in the event of a power outage or fault thereby enabling the user to manually lower and raise the wardrobe.

Preferably however the at least one drive motor is remotely controlled for example via a dedicated hand held device or by way of a wireless connection from a mobile device, such as a palm or mobile telephone. Likewise rail rotation may be similarly powered and controlled. Although preferably the rotation of hangers is performed automatically and under supervision of a controller which is dedicated to operate the actuator.

In a particularly preferred embodiment one or more proximity sensors are provided for sensing how close the wardrobe is to items or people as it is lowered. The, or each, proximity sensor may operate using ultra sonic or infrared beams. The, or each, proximity sensor is configured to send a signal to the drive motor (or its controller) to stop lowering the wardrobe in the event of a potential collision with an object, item of furniture, person or pet so as to avoid any physical damage or injury.

Preferably a low level light is located in one face of the wardrobe body. Ideally the low level light is battery powered and may have a touch sensitive panel which when touched brightens or dims the light. Lights may include light emitting diodes (LEDs) which may be automatically operated or switched on an off manually. Ideally an automatic device switches on the lights as the wardrobe is lowered in case this occurs in a darkened room or where light levels are low so that deployment of the wardrobe is clearly visible. The lights may be sized and dimensioned to match existing down lighters that may be present in a bedroom for example.

Optionally flat speakers may be provided which are built into panels of the wardrobe body. In another embodiment a display or other type of screen is provided so that one side or face of the wardrobe becomes an entertainment centre with the loudspeakers relying on a wooden or fibreboard panel of the wardrobe body to amplify bass frequencies.

In some embodiments a short range radio communication device (for example a Bluetooth® device or similar radio frequency (RF) transceiver, is provided which facilitates communication between a handheld remote control device and enables a user to select a particular function associated with a device mounted or the body of the wardrobe.

For example, in a preferred embodiment a controller is provided in or on the wardrobe body so that a signal received from the hand held device may control a brightness or colour of light from a lighting device fitted to the wardrobe body; or the volume of an audio device fitted to the wardrobe body; or select a channel of a television to be displayed on a screen that is mounted on the wardrobe body.

Electricity to power the, or each, device is ideally provided by one or more rechargeable batteries. A charging means charges the batteries and is provided in the form of a charging device with a connector which docks with a power supply when the wardrobe is retracted and locked in the stowed position in the loft.

In another embodiment a towel rail, which may be heated by way of a retracting mains cable, may also be provided. A suitable safety cut-off switch ensures the heater in the towel rail is automatically switched off when the wardrobe is retracted into the loft.

A yet further embodiment an audio alert, such a bleeper or buzzer, may trigger automatically and sound as the wardrobe is being raised or lowered so as to alert anyone who may be standing nearby.

The opening that defines a recess into which the wardrobe is received has a flexible, resiliently deformable lip that is formed from a synthetic rubber or flexible plastics material which contacts the sides of a base panel of the wardrobe and provides a seal around the base of the wardrobe when the wardrobe is retracted into the loft space. Ideally an insulation layer is located behind the seal in order to insulate a colder loft from a warmer room therebelow.

In another embodiment side flaps or panels may be configured to close over the opening that is revealed when the wardrobe is deployed thereby closing the aperture and acting as a temporary false ceiling. Alternatively the base of the wardrobe body is coloured and textured to match the ceiling or it may have a mirror or image be so that Where there is insufficient space to insulate the casket an insulating sock or cover may be placed around a box like structure which receives the wardrobe body.

In another embodiment the wardrobe may be received into an insulated housing or casket in the loft space thereby ensuring that the warmer air in a bedroom remains confined within a relatively small volume in the loft, rather than rising into the entire loft void. This insulated casket ensures that all the warm air in the room is not replaced by colder air sinking from the loft. Another advantage of the casket is that it prevents clothes condensation building up on clothes.

Where there is a significant loading one or more weight distribution bars may be provided to spread the weight of the wardrobe lengthwise along one or more joists or transversely across several joists. Weight distribution bars may be formed from steel, preferably stainless steel bars or L-sections.

Preferred embodiments of the invention will now be described by way of example only and with reference to the Figures in which:

DETAILED DESCRIPTION OF FIGURES

Figure 1:
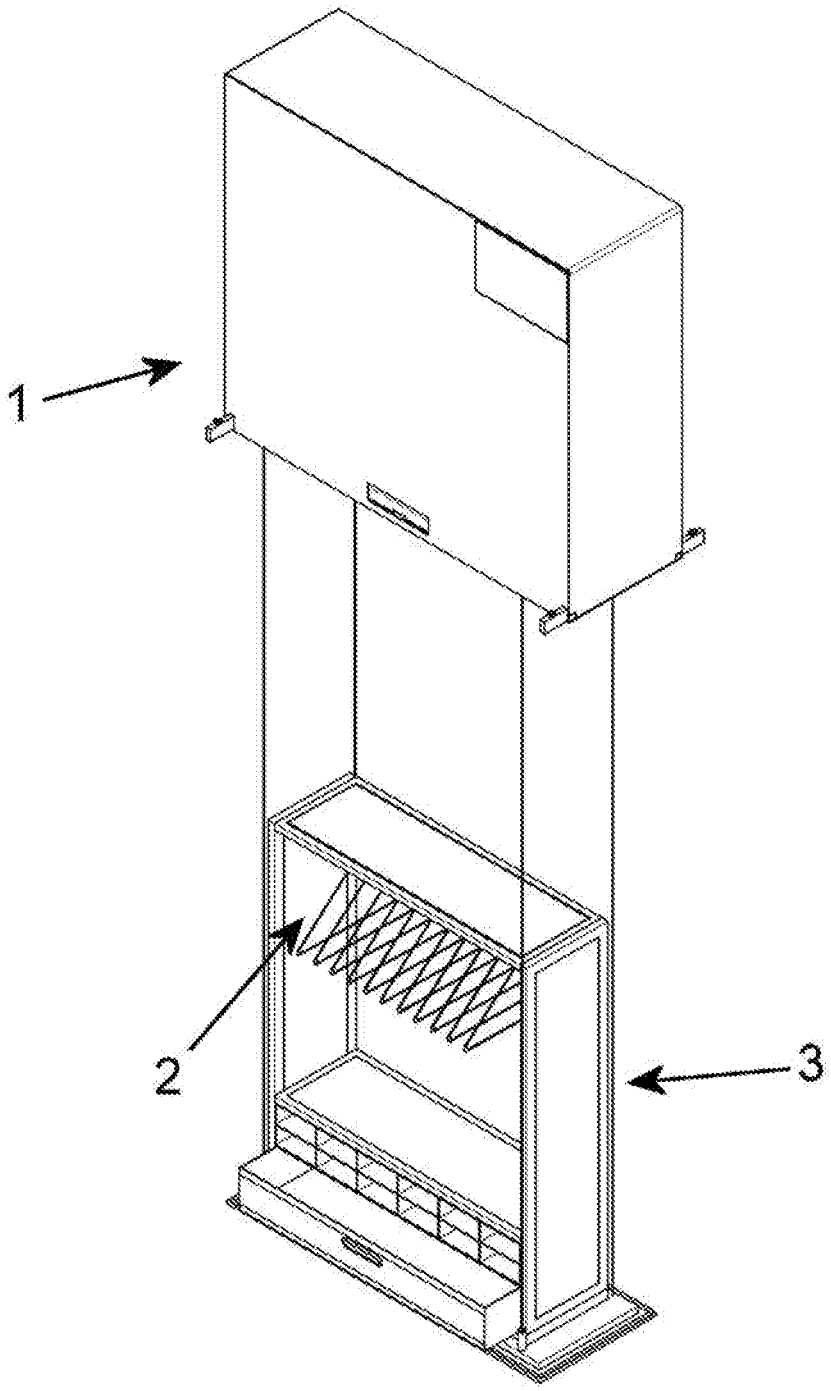
FIG. 1 shows an isometric view of an embodiment of the apparatus according to the present invention, in a first position.
Figure 2:
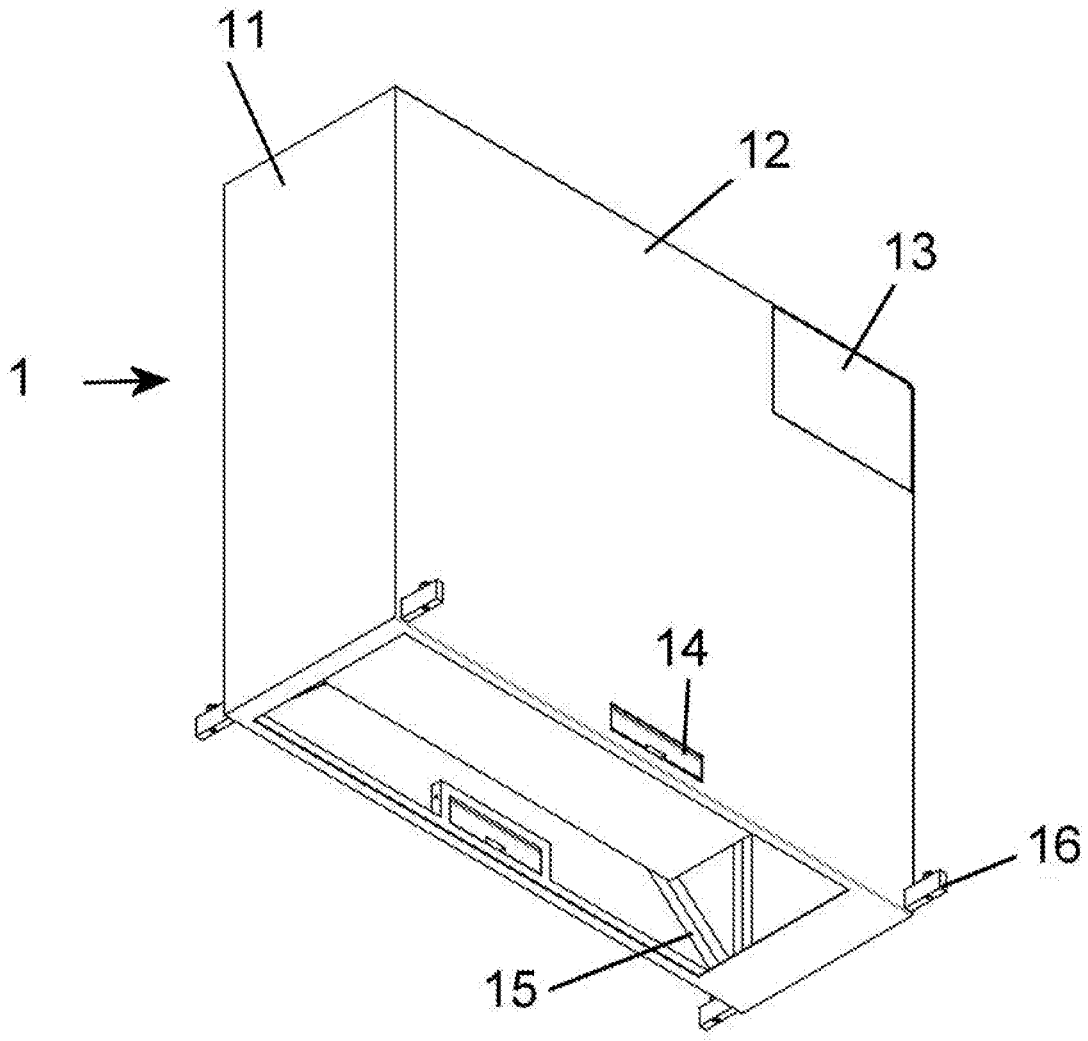
FIG. 2 shows a reverse isometric view of the embodiment shown in FIG. 1, in a second position.
Figure 3:
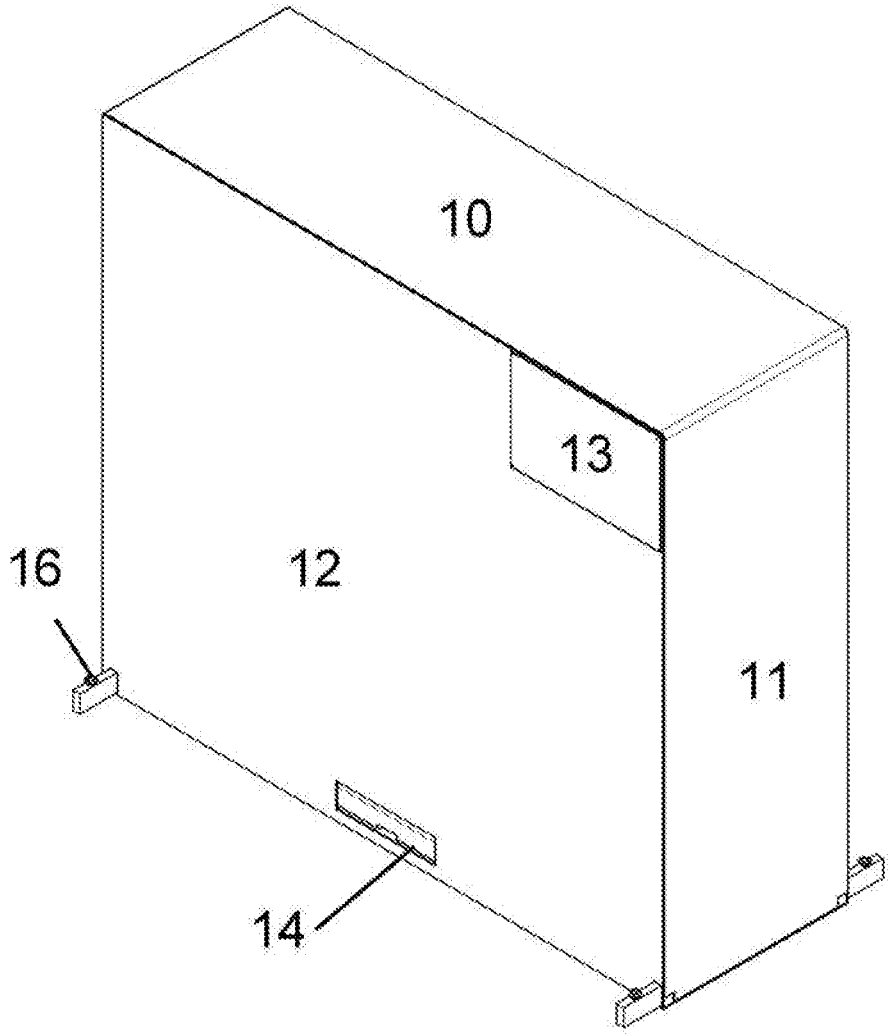
FIG. 3 shows an isometric view pf the embodiment as shown in FIG. 2.
Figure 4:
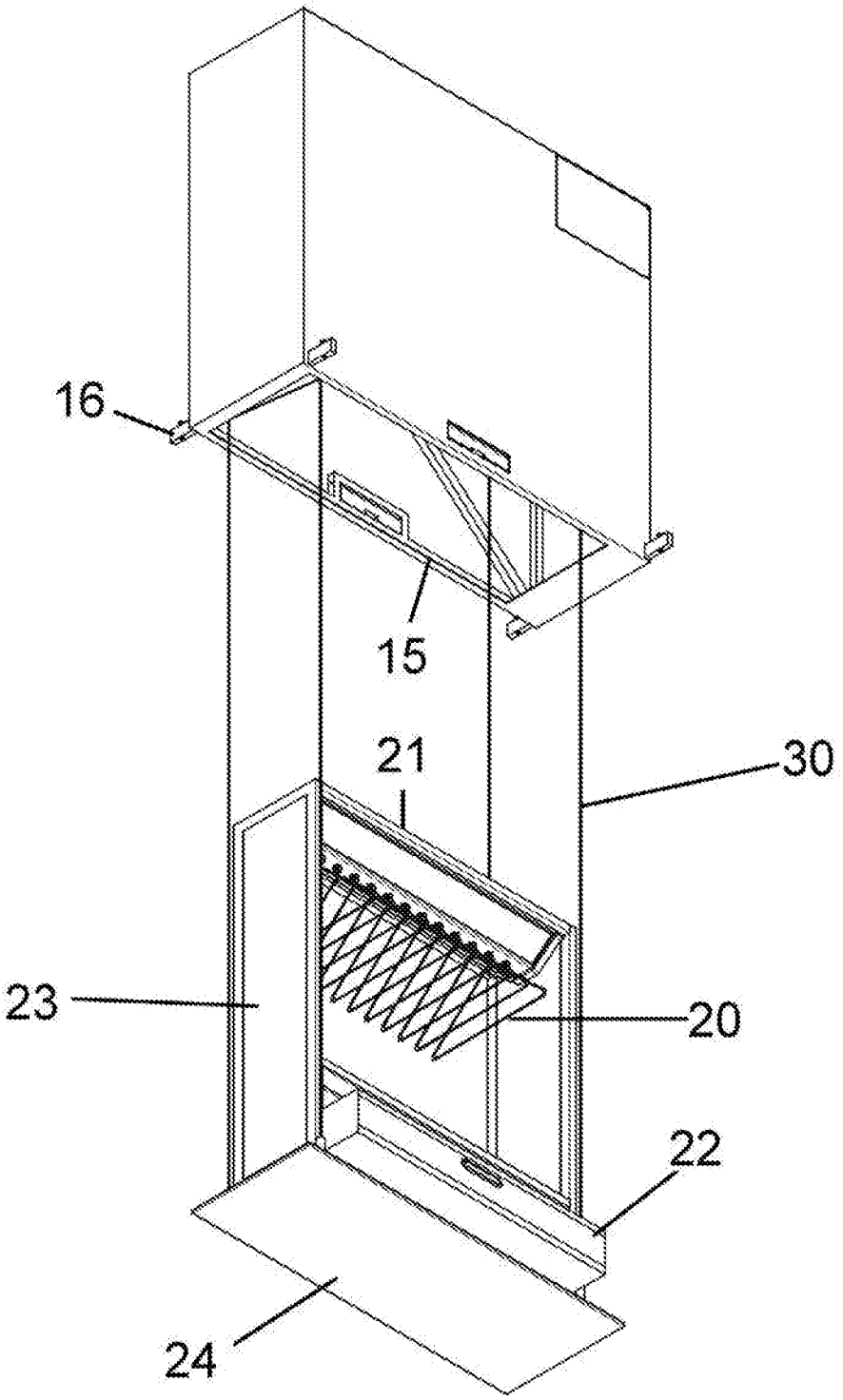
FIG. 4 shows a reverse isometric view of the embodiment as shown in FIG. 1.
Figure 5:
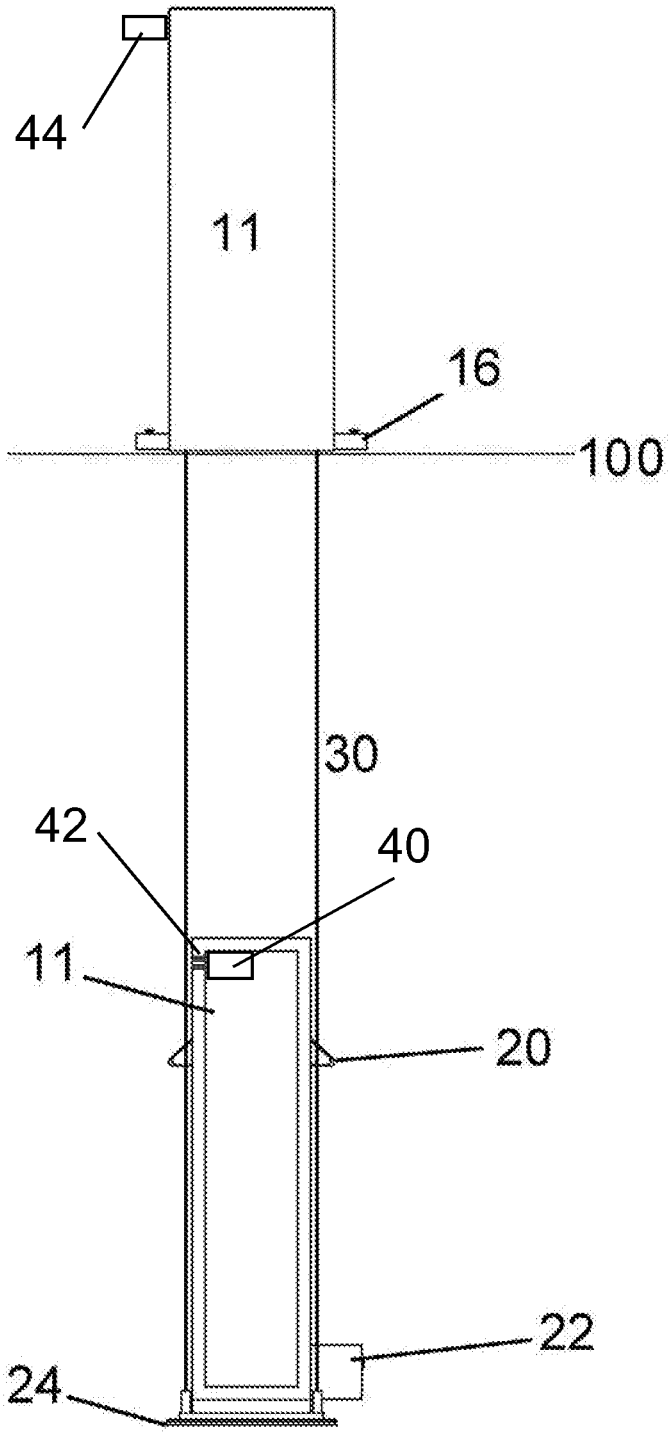
FIG. 5 shows an end view of the embodiment as shown in FIG. 1.
Figure 6:
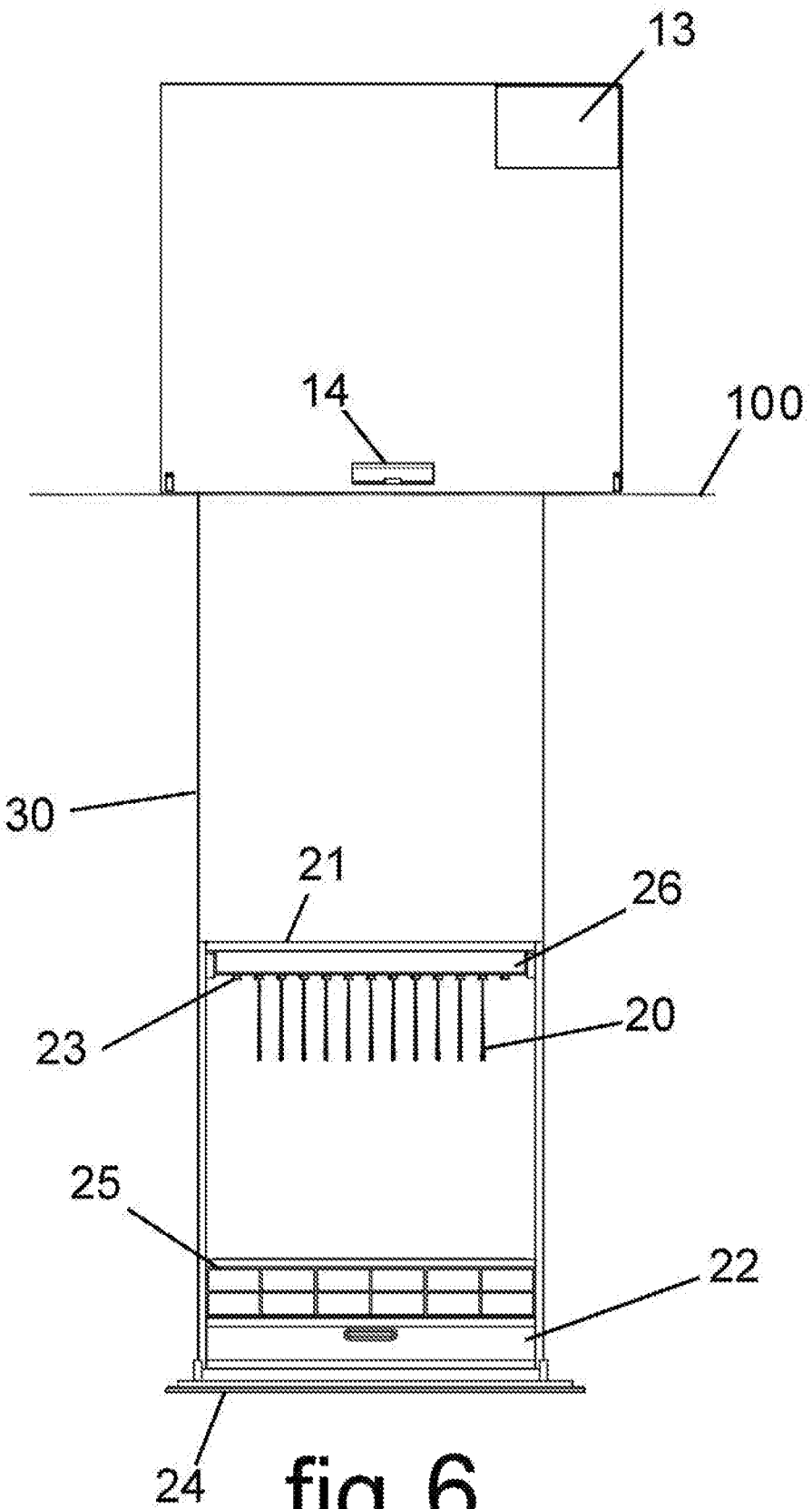
FIG. 6 shows a side view of the embodiment as shown in FIG. 1.
Figure 7A:
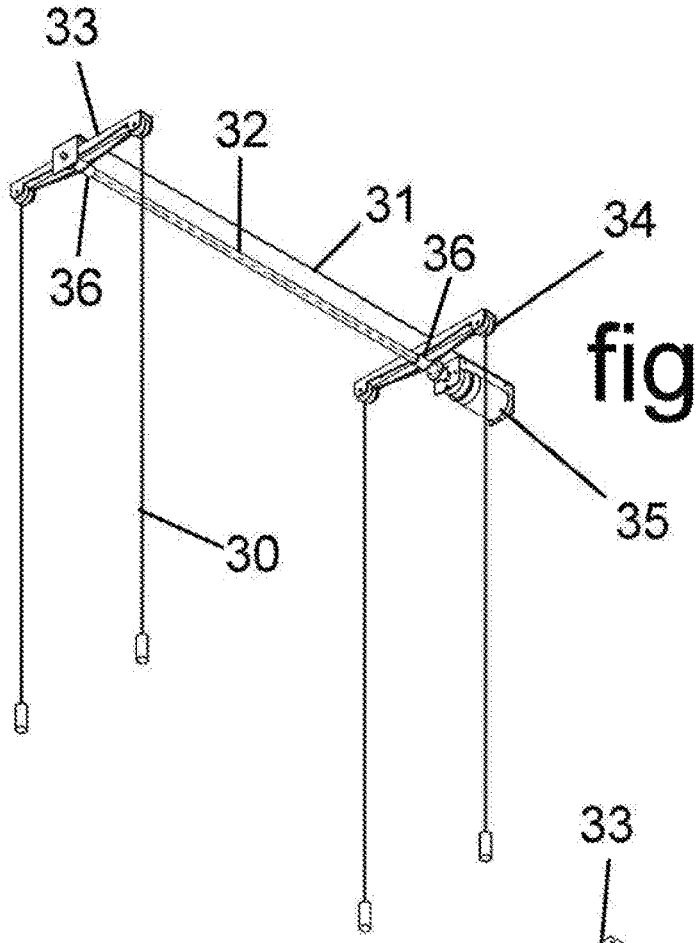
FIG. 7 show isometric views of internal parts of the embodiment shown in FIG. 1.
Figure 7B:
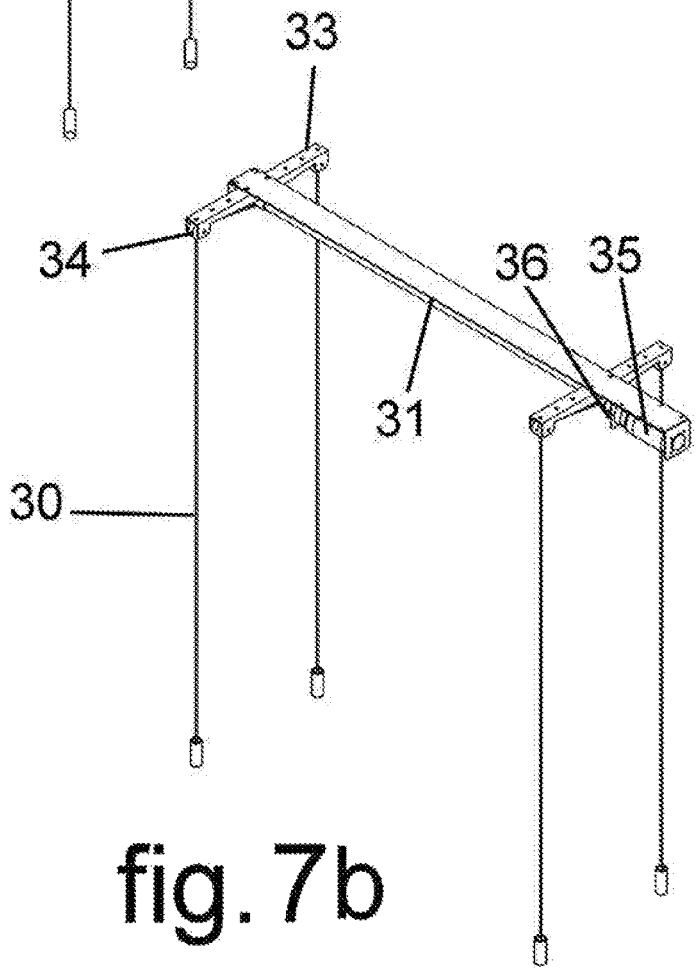
Figure 8A:
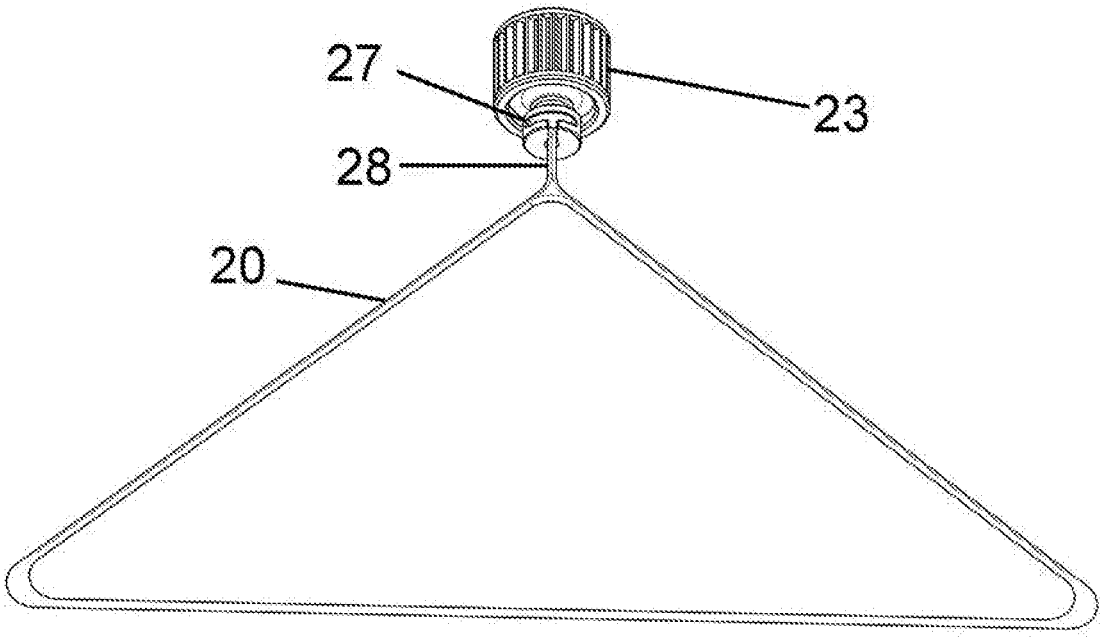
FIG. 8 show isometric views of hanger parts of the embodiment shown in FIG. 1.
Figure 8B:
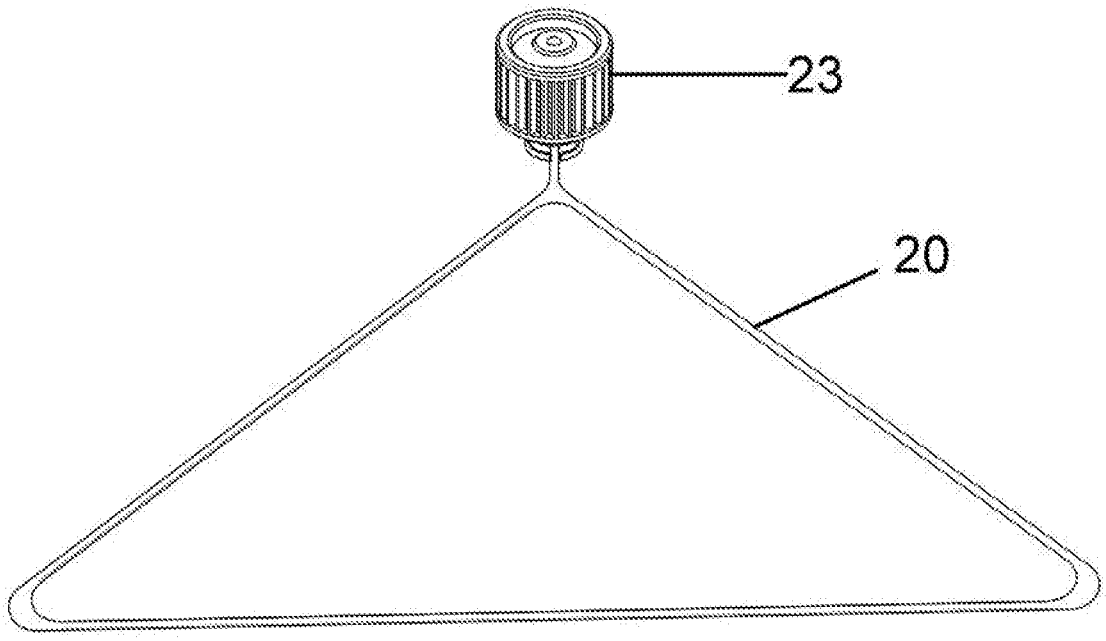
Figure 9:
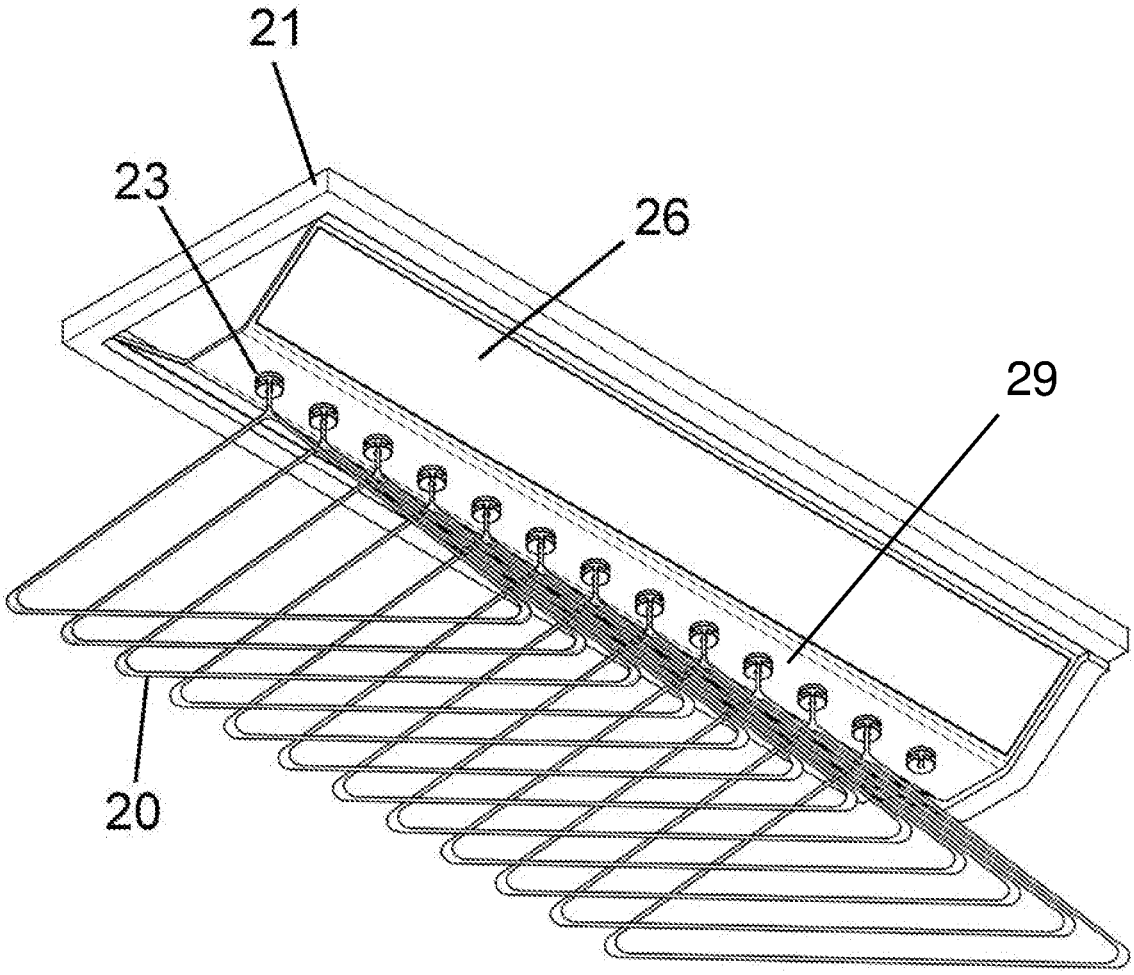
FIG. 9 shows a reverse isometric view of a rail part of the embodiment shown in FIG. 1.

With reference to the Figures there is shown an embodiment of the apparatus comprising wardrobe body 3 supporting a clothes rail 2, a frame 31, and an actuation means. The actuation means is arranged to move the rail 2 vertically from a first position distal the frame 1 to a second position proximate the frame 31.

The frame 1 supports and comprises a housing 10, 12, 14 and is rectangular in plan, such that the housing comprises two long sides 12 extending upwards, joined by two ends 11 and a top 10.

The rail 2 is supported in a body 3, which in the second position is covered by a plate 24, which may be used to hide the apparatus in use, for example comprising a paintable surface, which overlaps and fits into the ceiling plastering.

The housing is arranged to be inserted in a loft or attic space and fit between rafters. The rail is provided on and supported by the wardrobe body 3 which comprises two sides 26 and a top 21.

The housing comprises sheets of aluminium or mild steel. The structure is formed by braced skeleton panels 15. A displaceable hatch 13 allows access to the motor 35 or winch monarchism.

Four rafter support portions 16 extend from the lowest corners of the housing to engage the ceiling 100, or rafters 105, and have screw fastenings or are fastened by way of steel braces (not shown).

The sides 12 of the housing further comprise sprung lock tabs 14, which tabs 14 extend inwards from the sides 12 so as to engage the body 3 when the rail 2 is in the second (raised or stowed) position.

The actuation means comprises a motor 35 and flexible support members 30. The support members are four stainless steel multi-braid cables 30. The frame 31 comprises a longitudinal central rod 32 in the top 10 of the housing. The rod 32 has a motor 35 at one of its ends, which turns the rod 32. At either end of the rod 32 the frame 31 comprises two pulleys 34 or orthogonal extending arms 33. The central part of the pulley arms comprises a cable contact sleeve 36.

The cable contact sleeve 36 provides a resiliently deformable surface with sufficient friction to enable the cable to be easily wound round. Alternatively two, three or four separate motors may be used.

The cable members 30 are arranged in the corners of the frame 31 and housing. The cable members 30 comprise two lengths of cable at either end of the frame 31. The two lengths of cable are in contact with the sleeve 36, and are arranged to wind about the sleeve 36 when the rod 32 is rotated by the motor 35, in order to shorten the members 30, and accordingly move the body to the second higher position, or release the body to descend under gravity to the first position, as appropriate.

The rail comprises an elongate triangular cover section 26, with a lowermost flattened tip slot 29 extended from a topmost rectangular peripheral base 21 supporting a line of spaced apart collars 23 for the hangers 20.

The hangers 20 are semi-permanently secured on the rail. The hangers are in the form of triangular wires with a topmost corner comprising a rail securement means, which means comprises a collar 23 and a wire hanger, wherein the wire hanger has a T shaped top corner 28, interfaced in use with a T shaped slot 27 in a rotatable boss extending below the collar 23. In this way the hanger may be easily rotated for removal from the boss as 27 required.

Figure 10:
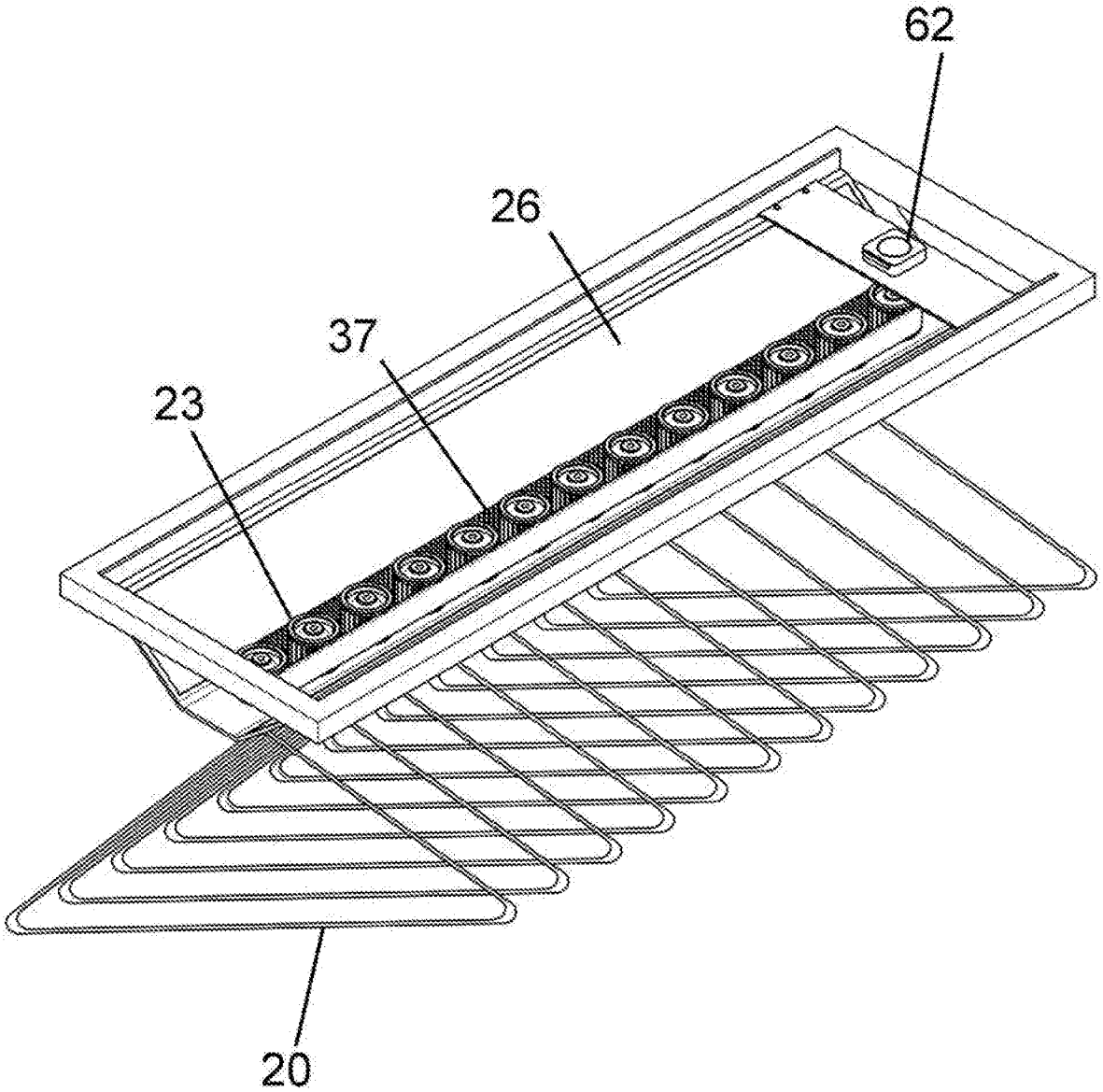
FIG. 10 shows an isometric view of the rail part shown in FIG. 9.
Figure 11:
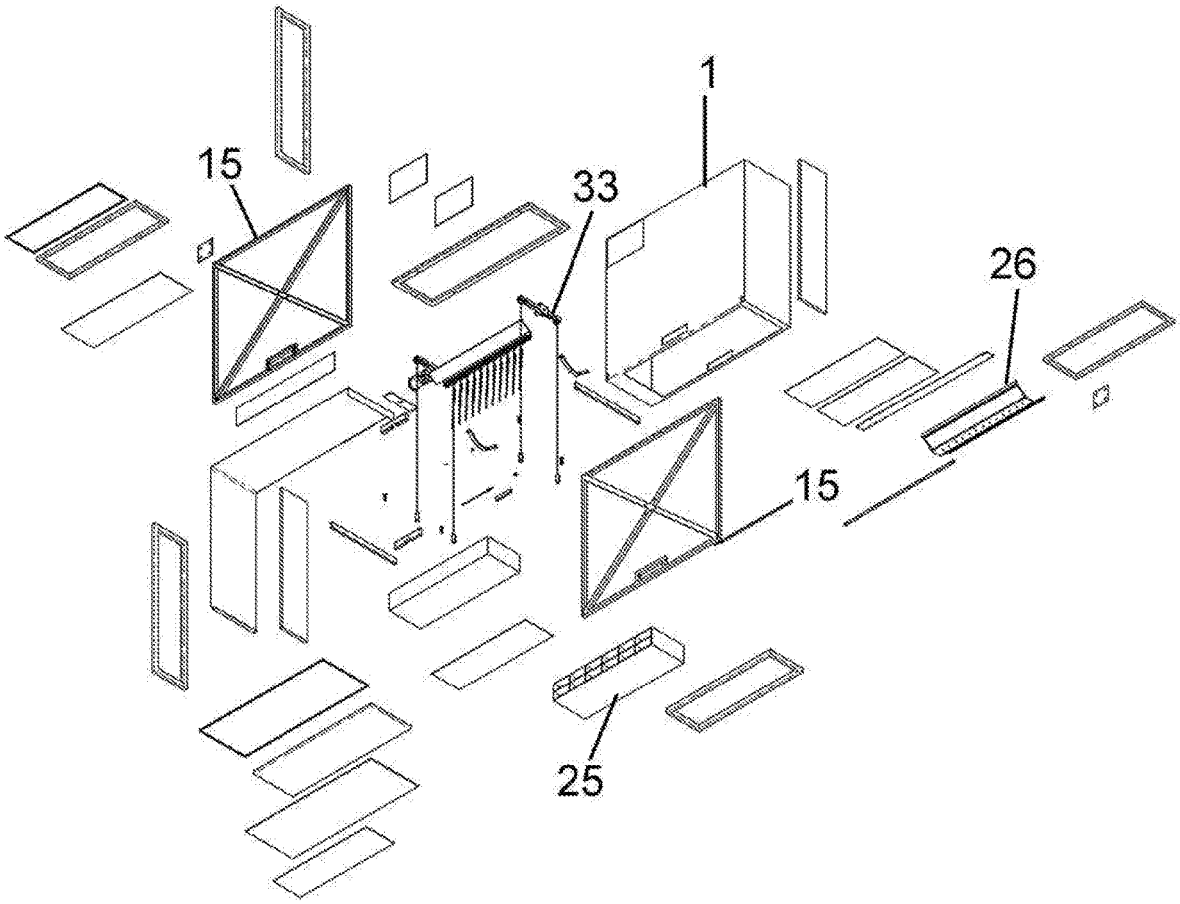
FIG. 11 shows an exploded isometric view of the embodiment shown in Figure.
Figure 12A:
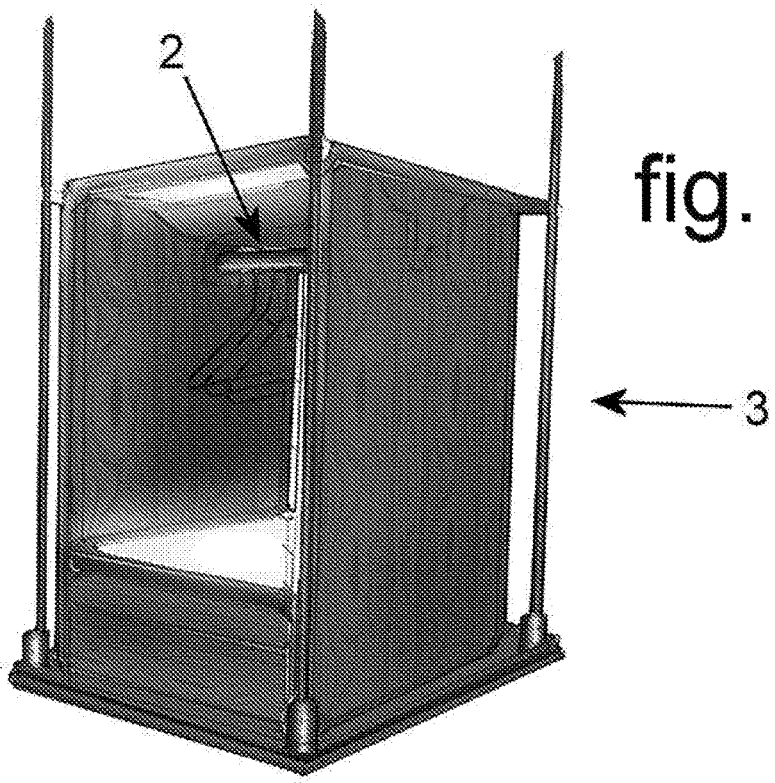
FIGS. 12 to 14 show sketch views of further embodiments of the apparatus according to the present invention.
Figure 12B:
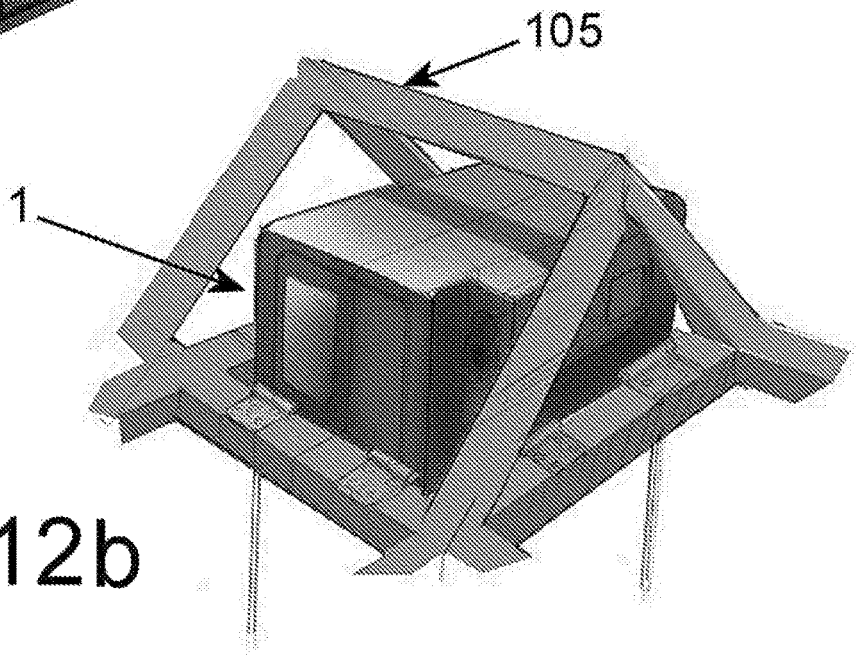
Figure 13A:
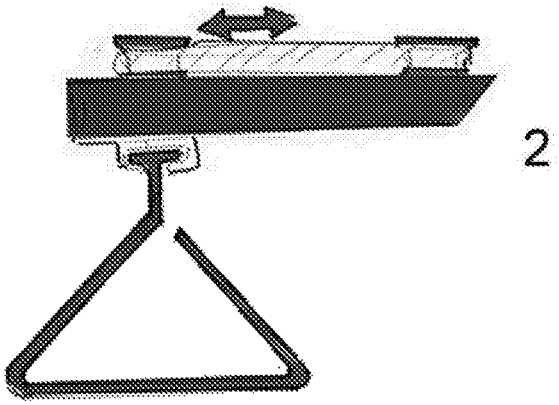
Figure 13B:
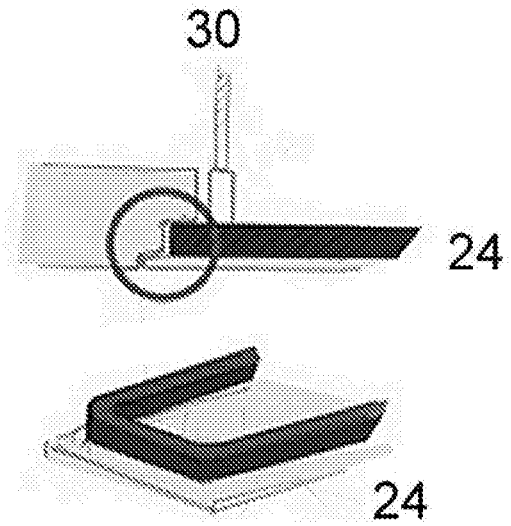
Figure 14A:
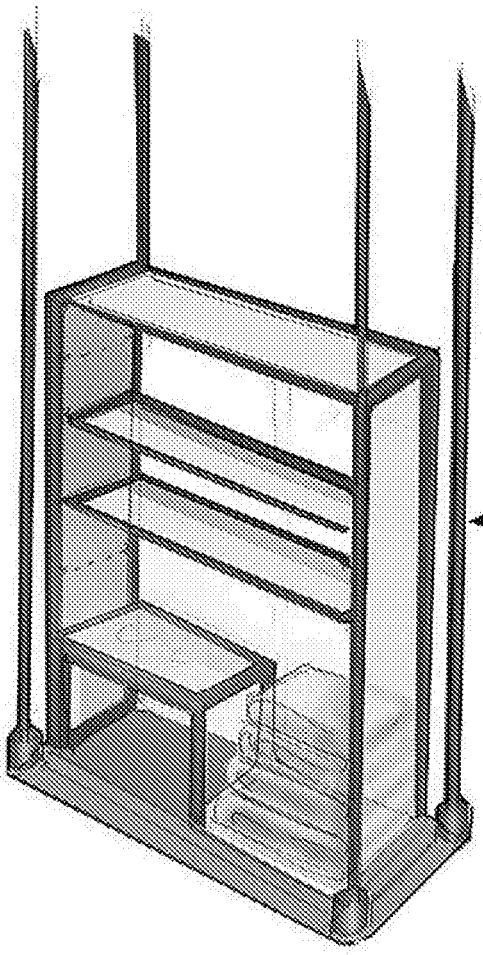
Figure 14B:
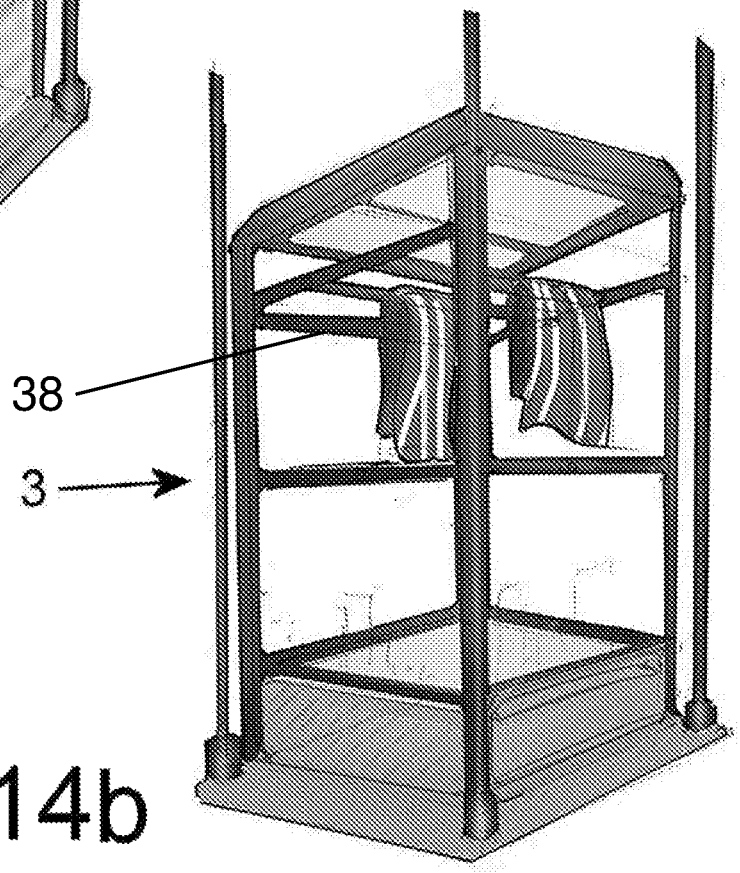

Due to the narrow span between rafters, the hangers are arranged to rotate 60° as the rail is raised and lowered. A small motor 62 (FIG. 10) is linked to a toothed belt 37 which rotates the collar teeth and facilitates this movement.

At least one of the at least one drive motor and the second motor can be powered by one or more batteries 40 that can be rechargeable and are fitted to the wardrobe body and move with the wardrobe body. Connectors 42 in operable communication with the batteries 40 and are arranged to contact a connection 44 in the loft so that the batteries 40 recharge when the wardrobe body is returned to the space in the loft in the retracted position.

The body further comprises storage compartments 25 and a drawer 22 which provides storage options at the bottom end of the body.

A towel rail 38, which may be heated by way of a retracting mains cable, may also be provided. A suitable safety cut-off switch ensures the heater in the towel rail 38 is automatically switched off when the wardrobe is retracted into the loft.

The invention has been described by way of examples only and it will be appreciated that variation may be made to the above-mentioned embodiments without departing from the scope of invention as defined by the claims. For example different types of fascia may be provided on an interior or exterior of the wardrobe body, including mirrored or polished surfaces. In addition devices incorporated onto the wardrobe body include: a safe and/or a fan each of which may also be wireless controlled.

The invention claimed is:

1. A wardrobe apparatus which in a retracted position is received in an insulated casket that is located in a space in a loft, and in deployed position is lowered into a room below the loft, the wardrobe apparatus comprising:

a wardrobe body including a clothes rail;

a frame fixed to or supported by a joist or beam in the loft, the frame defines an opening into the loft;

at least one drive motor configured to lower and raise the wardrobe body vertically;

a plurality of hangers operably engageable with the clothes rail; and an actuator configured to rotate the plurality of hangers with respect to the clothes rail during movement between the retracted and deployed positions, so as to enable the plurality of hangers to pass through the opening.

2. The wardrobe apparatus according to claim 1, wherein the plurality of hangers are linked together so that all the plurality of hangers rotate simultaneously.

3. The wardrobe apparatus according to claim 2, wherein the actuator includes a second motor and belt drive configured to rotate the hangers.

4. The wardrobe apparatus according to claim 3, wherein at least one of the at least one drive motor and the second motor is powered by one or more batteries.

5. The wardrobe apparatus according to claim 4, wherein the batteries are rechargeable and are fitted to the wardrobe body and move with the wardrobe body, and wherein the wardrobe body further comprises connectors in operable communication with the batteries and are arranged to contact a connection in the loft so that the batteries recharge when the wardrobe body is returned to the space in the loft in the retracted position.

6. The wardrobe apparatus according to claim 1, wherein the wardrobe body includes at least one shelf, at least one storage drawer, or at least one shelf and at least one storage drawer.

7. The wardrobe apparatus according to claim 1 further comprises a tension sensor configured to sense reduced tension in a cable operably associated with the at least one drive motor and halts the at least one drive motor.

8. The wardrobe apparatus according to claim 7 further comprises a controller that is operable to reverse the at least one drive motor to retract the cable when slackening is sensed by the tension sensor so that the wardrobe body is suspended a distance above a floor or other surface.

9. The wardrobe apparatus according to claim 1 further comprises a bar configured to spread a load of the wardrobe apparatus across or along one or more joists or rafters.

10. The wardrobe apparatus according to claim 1 further comprises one or more proximity sensors provided on the wardrobe body.

11. The wardrobe apparatus according to claim 10, wherein the, or each, proximity sensor includes an ultrasonic or an infra-red sensor and the proximity sensor is operable to send a signal to a controller which halts the at least one drive motor and thereby stops lowering of the wardrobe body to prevent a collision.

12. The wardrobe apparatus according to claim 1 further comprises:

a short range radio frequency transceiver that is configured or configurable to communicate with a handheld remote control device; and a controller configured or configurable so that a signal received from the handheld remote control device controls a level of lighting, or a volume of an audio device or select a channel to be displayed on a display screen.

13. The wardrobe apparatus according to claim 1 further comprises a heated towel rail powered via a retracting mains cable, and includes an automatic switch configured to isolate power to the heated towel rail when the wardrobe body is retracted into the loft.

14. The wardrobe apparatus according to claim 1 further comprising:

a light located in one face of the wardrobe body, wherein the light has a touch sensitive switch or is automatically operated by at least one switch associated with the light as the wardrobe body is lowered or raised;

audio speakers; or a screen provided on at least one side or face of the wardrobe body.

15. The wardrobe apparatus according to claim 1, wherein the opening in the loft where the wardrobe body is received, includes a flexible, resiliently deformable lip that is formed from a synthetic rubber material which contacts sides of the wardrobe body and provides a seal around a base of the wardrobe body when the wardrobe body is retracted into the loft space.

16. The wardrobe apparatus according to claim 1, wherein the clothes rail includes an elongate triangular cover section with a lowermost flattened tip slot extended from a topmost rectangular peripheral base.

17. The wardrobe apparatus according to claim 16, wherein each of the plurality of hangers is associated with a collar that is supported by the flattened tip slot of the clothes rail.

18. The wardrobe apparatus according to claim 17, wherein the actuator includes a second motor configured to drive a toothed belt, and the collar associated with each of the plurality of hangers includes exterior teeth engageable with the toothed belt and is configured to rotate the collar in relation to the clothes rail.

19. The wardrobe apparatus according to claim 18, wherein the collar includes a rotatable boss defining a T shaped slot, the T shaped slot is configured to receive a T shaped top corner of the plurality of hangers, respectively, so that the plurality of hangers are rotatable with and removable from the collar, respectively.

20. The wardrobe apparatus according to claim 1 further comprises a lifting frame associated with the frame, the lifting frame includes a longitudinal central rod in operable association with the at least one drive motor to rotate the central rod, and at least two orthogonal extending arms located at either end of the central rod, wherein ends of the orthogonal extending arms are configured to direct a cable or portion thereof toward the central rod for winding or unwinding of the cable.

* * * * *